US006193342B1

(12) United States Patent
Suzuki

(10) Patent No.: US 6,193,342 B1
(45) Date of Patent: Feb. 27, 2001

(54) INK JET PRINTER, AND INK DISCHARGE VELOCITY ADJUSTING METHOD AND APPARATUS IN THE SAME

(75) Inventor: Shogo Suzuki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/098,421

(22) Filed: Jun. 16, 1998

(30) Foreign Application Priority Data

Jun. 27, 1997 (JP) ..... 9-172436

(51) Int. Cl.[7] ..... B41J 29/38
(52) U.S. Cl. ..... 347/9
(58) Field of Search ..... 347/9, 10, 12, 347/14, 15, 11, 19, 70, 13

(56) References Cited

U.S. PATENT DOCUMENTS 3,828,357 * 8/1974 Koeblitz ..... 347/10
5,109,233 * 4/1992 Nishikawa ..... 347/12
5,510,816 * 4/1996 Hosono et al. ..... 347/12
5,594,475 * 1/1997 Komakine et al. ..... 347/9

FOREIGN PATENT DOCUMENTS 56-113473 * 9/1981 (JP) ..... 347/9
63-153149 * 6/1988 (JP) ..... 347/14

* cited by examiner

*Primary Examiner*—John Barlow
*Assistant Examiner*—Charles W. Stewart, Jr.
(74) *Attorney, Agent, or Firm*—Oliff & Berridge, PLC

(57) ABSTRACT

An ink jet printer is provided with: an ink discharge device for discharging ink, having (i) a body prescribing an ink flow path through which the ink is supplied, a plurality of ink storing chambers each connected to the ink flow path in which the supplied ink is temporarily stored and a plurality of ink discharge holes connected to respective one of the ink storing chambers though which the temporarily stored ink is discharged, and (ii) a plurality of piezoelectric elements for selectively changing capacities of the ink storing chambers; a driving voltage generating device for generating a driving voltage having a pulse-like waveform, which causes the ink to be discharged from each of the ink discharge holes by deforming the respective one of the piezoelectric elements; a plurality of analog switching devices for selectively opening and closing each current-carrying path, through which the driving voltage is supplied to the respective one of the piezoelectric elements; a power source voltage supplying device for supplying a power source voltage to the analog switching devices; a driving voltage adjusting device for changing at least one of a slope and an amplitude of the waveform of the driving voltage; and a power source voltage adjusting device for changing the power source voltage.

14 Claims, 11 Drawing Sheets

Vcc=5.0 [V], IOUT=±10 [mA], Ta=75 [℃]

INK JET PRINTER, AND INK DISCHARGE VELOCITY ADJUSTING METHOD AND APPARATUS IN THE SAME

BACKGROUND OF THE INVENTION

1. Field of the Invention

The present invention relates to an ink jet printer, and a method of and an apparatus for adjusting the ink discharge velocity in the ink jet printer.

2. Description of the Related Art

In such an ink jet printer, there is equipped an actuator of an ink jet head, which expands and restores the capacity of many ink storing chambers formed inside the actuator using a piezoelectric element installed corresponding to each of the ink storing chambers, and which applies pressure to the ink inside the ink storing chamber. In this way, the actuator discharges the ink from an ink discharge hole formed in each of the ink storing chambers to the external i.e., onto the recording sheet.

The ink discharge velocity of the actuator constructed in this manner varies depending upon the diameter of the ink discharge hole, the width or length of the ink storing chamber and the variation of the characteristics of the piezoelectric element and the like.

Hence, in order to correct this variance of the ink discharge velocity, either a driving voltage (i.e., a voltage of a wave for driving the piezoelectric element) or a driving voltage waveform (i.e., a waveform of a wave for driving the piezoelectric element) for expanding and restoring the piezoelectric element is adjusted or both of the driving voltage and the driving voltage waveform are adjusted.

However, according to the above mentioned ink jet head, since the driving voltage waveform and the driving voltage influence each other, it is a very cumbersome operation to adjust both of the driving voltage and driving voltage waveform.

In addition, in a case where the variance of the ink discharge velocity is corrected by adjusting only the driving voltage, the driving voltage needs to be adjusted over a wide range. However, in order to do this, the variable range of the power source voltage needs to be set very wide correspondingly, which caused a problem in the safety and the cost thereof.

SUMMARY OF THE INVENTION

Given these circumstances, it is an object of the present invention to provide an ink jet printer, and a method of and an apparatus for adjusting the ink discharge velocity in the ink jet printer, which can adjust the ink discharge velocity appropriately.

The above object of the present invention can be achieved by an ink jet printer provided with: an ink discharge device for discharging ink, having (i) a body prescribing an ink flow path through which the ink is supplied, a plurality of ink storing chambers each connected to the ink flow path in which the supplied ink is temporarily stored and a plurality of ink discharge holes connected to respective one of the ink storing chambers though which the temporarily stored ink is discharged, and (ii) a plurality of piezoelectric elements for selectively changing capacities of the ink storing chambers; a driving voltage generating device for generating a driving voltage having a pulse-like waveform, which causes the ink to be discharged from each of the ink discharge holes by deforming the respective one of the piezoelectric elements; a plurality of analog switching devices for selectively opening and closing each current-carrying path, through which the driving voltage is supplied to the respective one of the piezoelectric elements; a power source voltage supplying device for supplying a power source voltage to the analog switching devices; a driving voltage adjusting device for changing at least one of a slope and an amplitude of the waveform of the driving voltage; and a power source voltage adjusting device for changing the power source voltage.

According to the ink jet printer of the present invention, the driving voltage having the pulse-like waveform generated by the driving voltage generating device is supplied to respective one of the piezoelectric elements when the analog switching device closes the current-carrying path connected to the respective one of the piezoelectric elements. Thus, the ink is discharged from the ink discharge hole. At this time, the driving voltage adjusting device adjusts one or both of the slope and the amplitude of the waveform of the driving voltage, so as to generate a difference in the displacement velocity or the displacement amount of the piezoelectric element. As a result, the ink discharge velocity changes. On the other hand, when the power source voltage adjusting device changes the value of the power source voltage supplied to the analog switching devices, the ON resistance of the analog switching device changes, so that the waveform of the driving voltage is changed. As a result, the ink discharge velocity also changes in accordance with this change in the waveform. Therefore, the adjustment amount, which is necessary to be adjusted by the driving voltage adjusting device, decreases.

Consequently, the cost of the power source circuit can be reduced and the safety can be improved according to the ink jet printer of the present invention.

In one aspect of the ink jet printer of the present invention, the driving voltage adjusting device changes at least one of the slope and the amplitude of the waveform in accordance with the change in the power source voltage which is caused by the power source voltage adjusting device.

According to this aspect, when the power source voltage is changed by the power source voltage adjusting device, in accordance with this change, the driving voltage adjusting device changes at least one of the slope and the amplitude of the waveform. Therefore, the aforementioned driving voltage having the pulse-like shape is confined within a prescribed power source voltage range and does not destroy the analog switching device.

Consequently, the analog switching devices can be properly driven.

In this aspect, the driving voltage generating device may be provided with a first switching device for decreasing the driving voltage from a predetermined maximum value to a predetermined minimum value and a second switching device for increasing the driving voltage from the predetermined minimum value to the predetermined maximum value. And that, the first switching device and the second switching device may share the power source voltage, which is changed by the power source voltage adjusting device, with the analog switching devices.

In this case, the first switching device decreases the driving voltage from the predetermined maximum value to the predetermined minimum value, and the second switching device increases the driving voltage from the predetermined minimum value to the predetermined maximum value. At this time, since the first switching device and the second switching device share the power source voltage, which the power source voltage adjusting device changes, with the analog switching devices, even if the power source voltage adjusting device changes the power source voltage for the analog switching device as described above, the driving voltage is confined within a prescribed power source voltage range, and does not destroy the analog switching device. As a result, the analog switching devices can be properly driven.

In another aspect of the ink jet printer of the present invention, the power source voltage adjusting device is provided with a variable resistor and a Zener circuit for changing the power source voltage.

According to this aspect, by virtue of the variable resistor and the Zener circuit, the power source voltage can be appropriately adjusted. Thus, by employing a relatively simple construction, it is possible to adjust the ink discharge velocity.

In another aspect of the ink jet printer of the present invention, each of the analog switching devices is provided with a transmission gate, through which the driving voltage is supplied to the respective one of the piezoelectric elements, and whose ON resistance varies depending on the power source voltage supplied thereto.

According to this aspect, since the ON resistance of each transmission gate is certainly changed, it is possible to change the driving voltage by changing the ON resistance of the analog switching devices.

The above object of the present invention can be also achieved by a method of adjusting an ink discharge velocity of an ink jet printer. The ink jet printer is provided with: an ink discharge device for discharging ink, having (i) a body prescribing an ink flow path through which the ink is supplied, a plurality of ink storing chambers each connected to the ink flow path in which the supplied ink is temporarily stored and a plurality of ink discharge holes connected to respective one of the ink storing chambers though which the temporarily stored ink is discharged, and (ii) a plurality of piezoelectric elements for selectively changing capacities of the ink storing chambers; a driving voltage generating device for generating a driving voltage having a pulse-like waveform, which causes the ink to be discharged from each of the ink discharge holes by deforming the respective one of the piezoelectric elements; a plurality of analog switching devices for selectively opening and closing each current-carrying path, through which the driving voltage is supplied to the respective one of the piezoelectric elements; and a power source voltage supplying device for supplying a power source voltage to the analog switching devices. Here, the ink discharge velocity adjusting method of the present invention is provided with: a driving voltage adjusting process of changing at least one of a slope and an amplitude of the waveform of the driving voltage, which is generated by the driving voltage generating device; and a power source voltage adjusting process of changing the power source voltage, which is supplied by the power source voltage supplying device.

According to the ink discharge velocity method of the present invention, if at least one of the slope and the amplitude of the waveform of this driving voltage is changed, the ink discharge velocity changes, while, if the power source voltage adjusting process changes the value of the power source voltage supplied to the analog switching device, the ink discharge velocity also changes in accordance with this change in the waveform shape, in the same manner as in the above described case of the apparatus of the present invention. Therefore, the amount required to adjust the slope or amplitude of the waveform of the driving voltage decreases. Consequently, the cost of the power source circuit can be reduced and the safety can be improved according to the ink discharge velocity printer of the present invention.

In one aspect of the ink discharge velocity adjusting method of the present invention, the driving voltage adjusting process changes at least one of the slope and the amplitude of the waveform in accordance with the change in the power source voltage which is caused by the power source voltage adjusting process.

According to this aspect, when the power source voltage is changed by the power source voltage adjusting process, the driving voltage adjusting process changes at least one of the slope and the amplitude of the waveform, in the same manner as in the case of one aspect of the ink jet printer of the present invention. Consequently, the analog switching devices can be properly driven.

In this aspect, the driving voltage generating device may share the power source voltage, which is changed by the power source voltage adjusting process, with the analog switching devices.

In this case, since the first switching device and the second switching device share the power source voltage with the analog switching devices, even if the power source voltage adjusting process changes the power source voltage for the analog switching device as described above, the driving voltage is confined within a prescribed power source voltage range, and does not destroy the analog switching device. As a result, the analog switching devices can be properly driven.

The above object of the present invention can be also achieved by an apparatus for adjusting an ink discharge velocity of an ink jet printer. The ink jet printer is provided with: an ink discharge device for discharging ink, having (i) a body prescribing an ink flow path through which the ink is supplied, a plurality of ink storing chambers each connected to the ink flow path in which the supplied ink is temporarily stored and a plurality of ink discharge holes connected to respective one of the ink storing chambers though which the temporarily stored ink is discharged, and (ii) a plurality of piezoelectric elements for selectively changing capacities of the ink storing chambers; a driving voltage generating device for generating a driving voltage having a pulse-like waveform, which causes the ink to be discharged from each of the ink discharge holes by deforming the respective one of the piezoelectric elements; a plurality of analog switching devices for selectively opening and closing each current-carrying path, through which the driving voltage is supplied to the respective one of the piezoelectric elements; and a power source voltage supplying device for supplying a power source voltage to the analog switching devices. The ink discharge velocity adjusting apparatus is provided with: a driving voltage adjusting device for changing at least one of a slope and an amplitude of the waveform of the driving voltage; and a power source voltage adjusting device for changing the power source voltage.

According to the ink discharge velocity adjusting apparatus of the present invention, in the same manner as the aforementioned ink discharge velocity adjusting method of the present invention, the amount required to adjust the slope or amplitude of the waveform of the driving voltage decreases, so that the cost of the power source circuit can be reduced and the safety can be improved.

In one aspect of the ink discharge velocity adjusting apparatus of the present invention, the driving voltage adjusting device changes at least one of the slope and the amplitude of the waveform in accordance with the change in the power source voltage which is caused by the power source voltage adjusting device.

In this aspect, the driving voltage generating device may be provided with a first switching device for decreasing the driving voltage from a predetermined maximum value to a predetermined minimum value and a second switching device for increasing the driving voltage from the predetermined minimum value to the predetermined maximum value, the first switching device and the second switching device sharing the power source voltage, which is changed by the power source voltage adjusting device, with the analog switching devices.

In another aspect of the ink discharge velocity adjusting apparatus of the present invention, the power source voltage adjusting device is provided with a variable resistor and a Zener circuit for changing the power source voltage.

In another aspect of the ink discharge velocity adjusting apparatus of the present invention, each of the analog switching devices is provided with a transmission gate, through which the driving voltage is supplied to the respective one of the piezoelectric elements, and whose ON resistance varies depending on the power source voltage supplied thereto.

According to the above described various aspects of the ink discharge velocity adjusting apparatus of the present invention, the same advantageous effects as those in the aforementioned various aspects of the ink jet printer of the present invention can be respectively achieved in the same manner.

The nature, utility, and further features of this invention will be more clearly apparent from the following detailed description with respect to preferred embodiments of the invention when read in conjunction with the accompanying drawings briefly described below.

DETAILED DESCRIPTION OF THE PREFERRED EMBODIMENT

A preferred embodiment for the present invention is explained with reference to the drawings.

Figure 1:
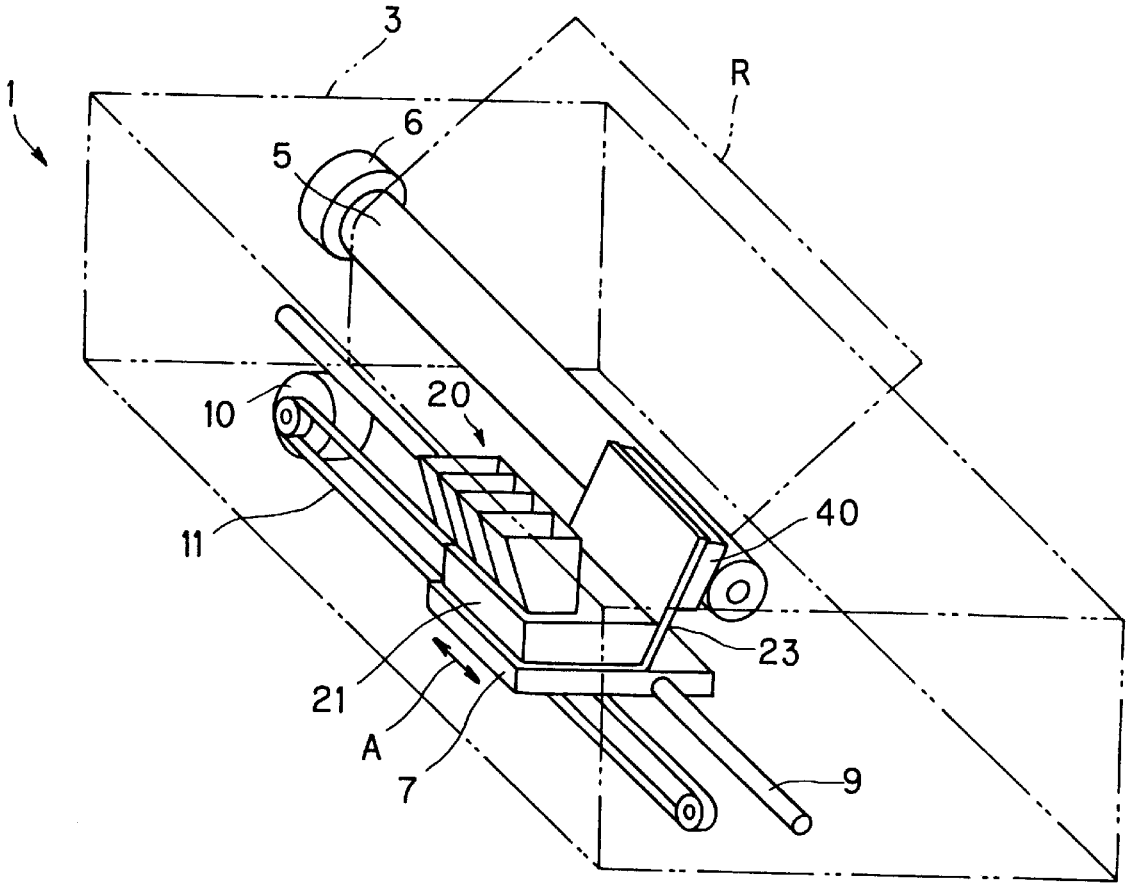
FIG. 1 is a perspective view showing the internal of an ink jet printer 1 according to an embodiment of the present invention.

FIG. 1 is a perspective view showing the internal of an ink jet printer (hereafter, this may be also called simply as a printer) 1 according to an embodiment of the present invention.

In FIG. 1, the printer 1 is provided with a transport roller 5, which is driven by a transport motor 6, for transporting a recording paper R, as one example of a recording medium to be recorded with, toward an upper side of the printer 1 in a frame body 3 thereof. A head 20 supported by a carriage 7 is installed in the transport path of the recording paper R. Moreover, a supporting member 9 that is fixed on the frame body 3 supports the carriage 7 movably in the back and forth directions indicated by an arrow A orthogonal to the transport direction of the recording paper R. In addition, a timing belt 11 which the carriage motor 10 drives fixes the carriage 7, enabling the carriage 7 to move freely the back and forth directions indicated by the arrow A.

The head 20 is provided with: ink tanks 21 for storing inks of four colors (i.e., yellow, magenta, cyan, and black); ink discharging actuators 40 for discharging the inks of four colors; and a front panel 23 for transporting the ink from the respective ink tanks 21 to the corresponding actuators 40.

Figure 2:
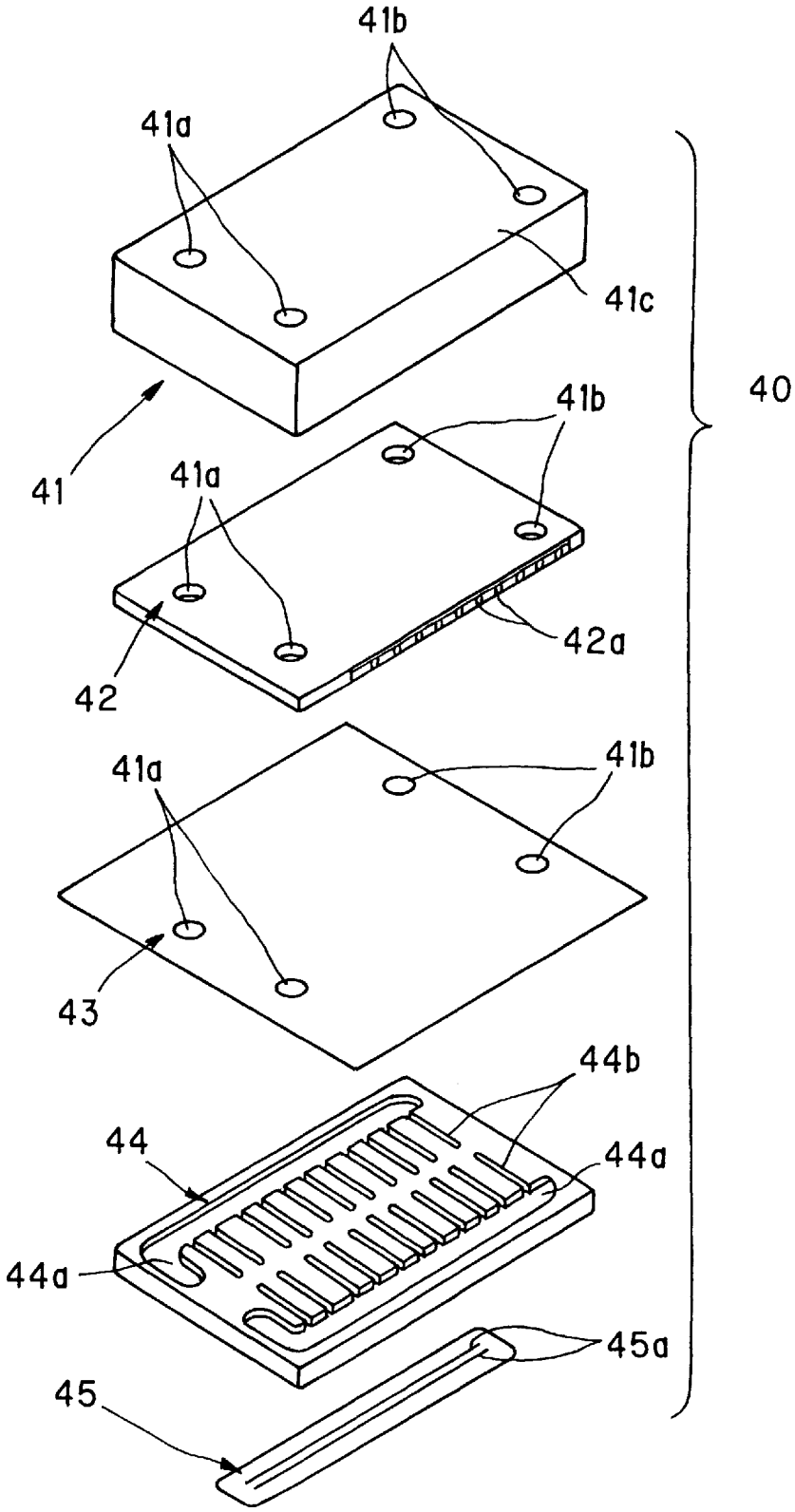
FIG. 2 is a perspective separation view showing an actuator 40 of the printer 1 according to the embodiment of the present invention.

As shown in FIG. 2, each of the actuators 40 is provided with a base 41, a piezoelectric element member 42, a diaphragm 43, a cavity plate 44 and a nozzle plate 45.

The nozzle plate 45 is a flat plate on which multiple (for example, 128) ink discharge holes 45*a* are arranged in two rows respectively. The cavity plate 44 has two L-shaped ink flow paths 44*a*, and ink storing chambers 44*b* that branch out perpendicularly from the ink flow paths 44*a*. The number of the ink storing chambers 44*b* is equal to the number of the ink discharge holes 45*a*. Each of the ink storing chambers 44*b* is connected to the respective one of the ink discharge holes 45*a*.

Electrodes for supplying the electric power to each of the piezoelectric elements 42*a* are installed on the end face of the piezoelectric element member 42. The electrodes are soldered with a flexible cable on the end face, so as to be connected with a driving circuit described later (i.e., a driving circuit 32 in FIG. 4).

The diaphragm 43 separates the piezoelectric element member 42 from the cavity plate 44, and has elasticity.

The base 41 supports each of the above-described components of the actuator 40.

Two forward paths 41*a* and two backward paths 41*b* for circulating the ink from the ink tank not shown in the drawing through the ink flow paths 44*a* penetrate through the base 41, the piezoelectric element 42, and the diaphragm 43.

Next, one of the ink storing chambers 44*b* will be explained with reference to FIG. 3 that magnifies the cross section of the ink storing chamber 44*b*.

Figure 3:
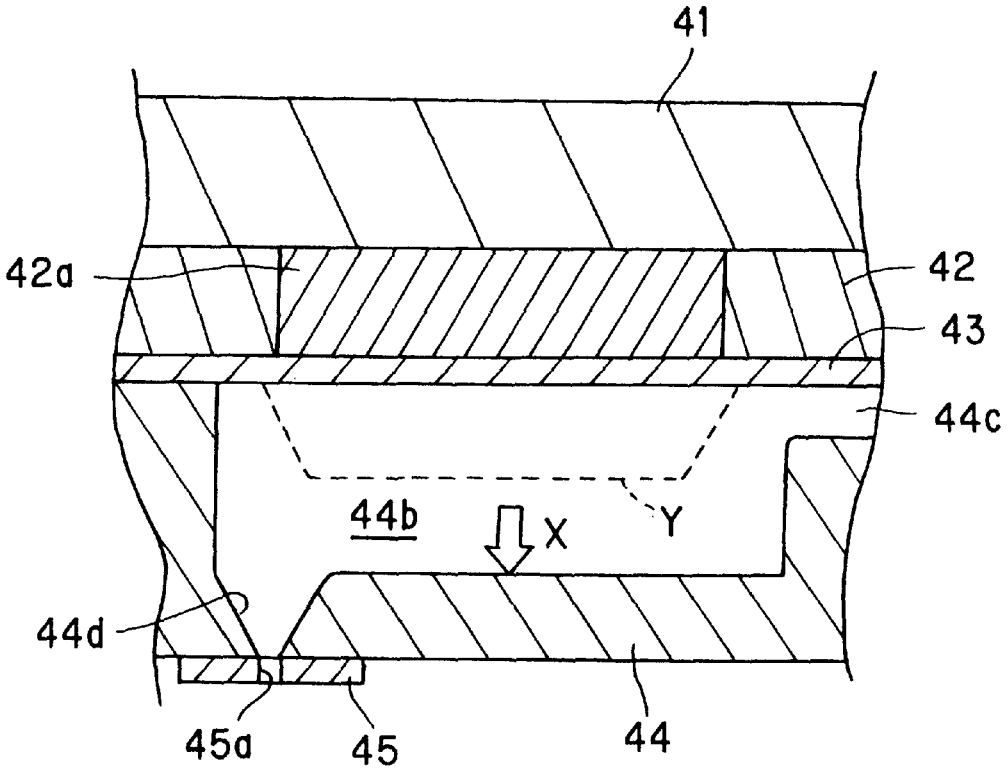
FIG. 3 is a vertical cross sectional view showing a vertical cross section of the actuator 40 of the printer 1 according to the embodiment of the present invention.

In FIG. 3, each of the ink storing chambers 44*b* formed on the cavity plate 44 is connected to respective one of the ink flow paths 44*a* (in FIG. 2) via a connecting path 44*c*. An orifice 44*d* for leading to the respective ink discharge hole 45*a* is formed at the bottom of the ink storing chamber 44*b*.

When a driving voltage is applied to the respective piezoelectric element 42*a*, the piezoelectric element 42*a* expands in the direction indicated by an arrow X, so as to shrink the capacity of the ink storing chamber 44*b* as indicated by a broken line Y. When the driving voltage is released, the piezoelectric element 42*a* restores or returns to its original initial state by the elasticity of the diaphragm 43.

Next, an operation of controlling the head 20, that is constructed in the above-described manner, to discharge the ink from the actuator 40 will be explained with reference to FIG. 1 to FIG. 3.

The ink is compressed and fed from the ink tank 21 (shown in FIG. 1) to the pair of the ink flow paths 44*a* passing through the pair of forward paths 41*a*, and fills the ink flow path 44*a* (shown in FIG. 2). By releasing the driving voltage, the original state of the piezoelectric element 42*a* is restored. The ink is then guided through the ink flow path 44*a* and the connecting path 44*c*, to be thereby drawn into the ink storing chamber 44*b*. Thus, the ink storing chamber 44*b* is filled with the ink.

Then, by applying the driving voltage to the piezoelectric element 42*a* so as to shrink the capacity of the ink storing chamber 44*b*, the ink is guided through the orifice 44*d* to the ink discharge hole 45*a*, and is discharged outside of the ink storing chamber 44*b*.

By this ink discharge operation of the actuator 40, the ink is discharged from the actuator 40 onto the recording paper R.

Next, a control device 30 for controlling the ink discharge operation of the above-described printer 1 will be explained with reference to the block diagram shown in FIG. 4.

Figure 4:
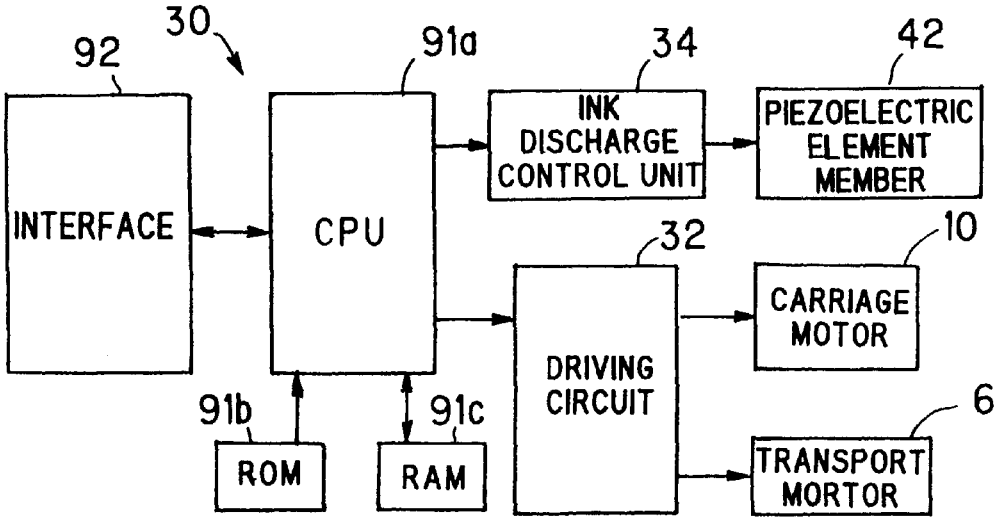
FIG. 4 is a block diagram of a control device 30 of the printer 1 according to the embodiment of the present invention.

In FIG. 4, the control device 30 is provided with: a CPU 91*a* for performing various calculation operations; a ROM 91*b* and a RAM 91*c* for storing a program and a parameter that are required to control the printer 1; an interface 92 for sending and receiving data that is needed for recording between the printer 1 and a personal computer etc., not shown in the drawing; a driving circuit 32 for driving the carriage motor 10 and the transport motor 6 based on a control signal supplied from the CPU 91*a*; and an ink discharge control unit 34 for controlling the actuator 40 to discharge the ink by expanding the respective piezoelectric element 42*a* of the piezoelectric element member 42 under the control of the CPU 91*a*.

Figure 5:
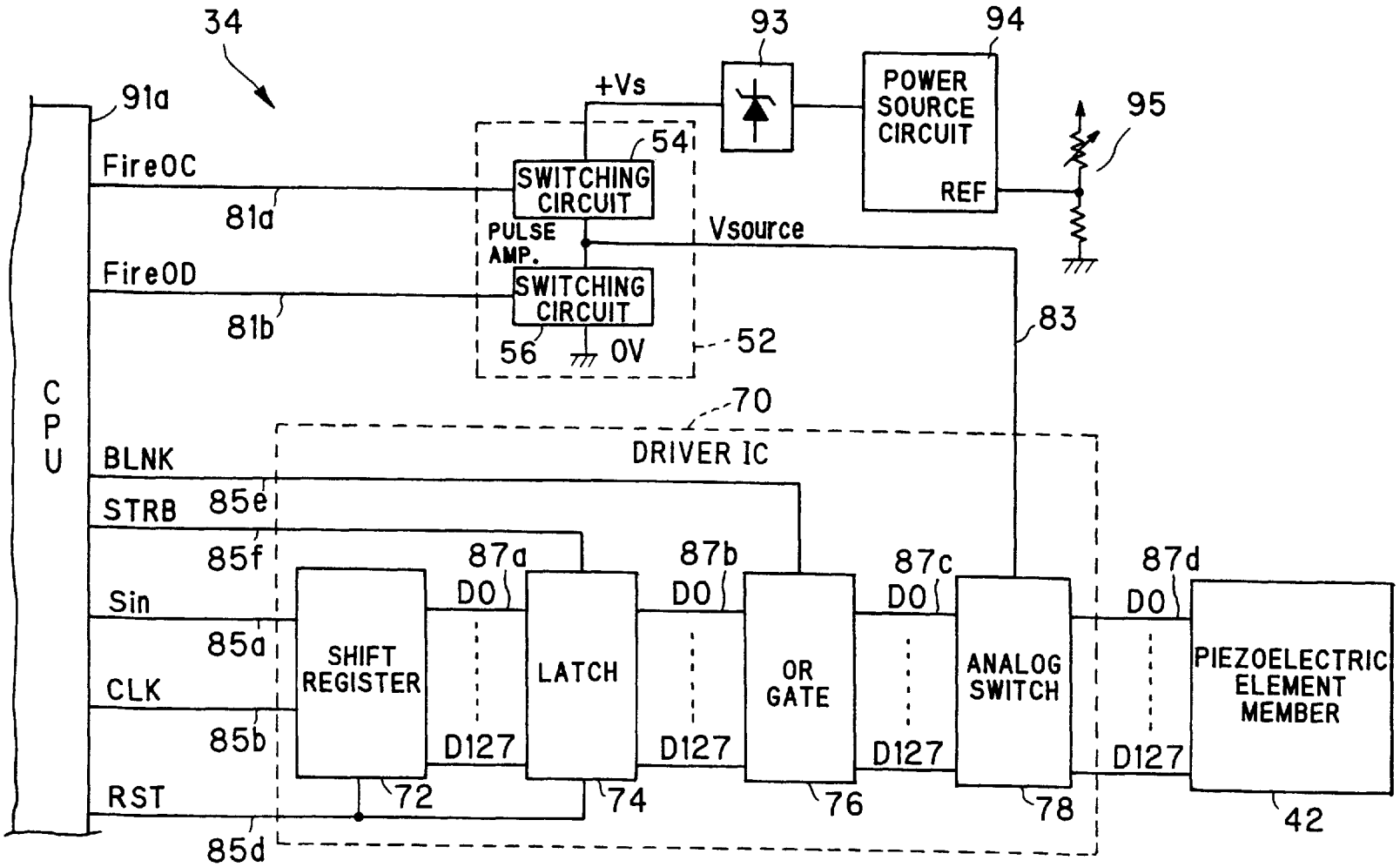
FIG. 5 is a block diagram of an ink discharge control unit 34 of the printer 1 according to the embodiment of the present invention.

As shown in FIG. 5, the ink discharge control unit 34 is provided with: a pulse amplifier 52 as one example of a driving voltage generating device and also as one example of a driving voltage adjusting device for supplying a Vsource voltage to each of the piezoelectric elements 42*a* of the piezoelectric element member 42; and a driver IC 70 capable of selectively opening and closing a current-carrying path 87*d* through which the Vsource voltage from the pulse amplifier 52 is transmitted to the respective piezoelectric element 42*a*.

The pulse amplifier 52 supplies the Vsource voltage, which changes in a pulse shape between a predetermined voltage of +Vs[V] and a voltage of 0[V], as a driving voltage for expanding or restoring the capacity of respective piezoelectric elements 42*a*, to the piezoelectric element member 42. The pulse amplifier 52 has a switching circuit 54 as one example of a first switching device for increasing the Vsource voltage, which is supplied to the piezoelectric element member 42, from 0[V] to +Vs[V] with a predetermined slope, and a switching circuit 56 as one example of a second switching device for decreasing the Vsource voltage from +Vs[V] to 0[V] with a predetermined slope.

The switching circuit 54 increases the Vsource voltage to +Vs[V] when the CPU 91*a* sends a Fire0C signal at a High signal, via a bus 81*a* to the switching circuit 54.

The switching circuit 56 decreases the Vsource voltage to 0[V] when the CPU 91*a* sends a Fire0D signal at a High signal, via a bus 81*b* to the switching circuit 56.

The driver IC 70 has a shift register 72, a latch 74, an OR gate 76 and analog switches 78.

The shift register 72 shifts a Sin signal, which is sent as digital serial data from the CPU 91*a* via a bus 85*a*, for selectively opening and closing 128 analog switches 78 in synchronization with a CLK signal (i.e., a pulse-like clock signal whose period corresponds to the transfer speed of the serial data) that is sent from the CPU 91*a* via a bus 85*b*. The shift register 72 then outputs the parallel output of the shifted Sin signal as D0 through D127 signals to the latch 74 through 128 parallel paths 87*a*.

The latch 74 stores the D0 through D127 signals which the shift register 72 has outputted via the parallel paths 87*a*. When the latch 74 receives a STRB signal (strobe signal) from the CPU 91*a* via a bus 85*f*, the latch 74 simultaneously outputs the D0 through D127 signals to the OR gate 76 via parallel paths 87*b*.

If the OR gate 76 receives the D0 through D127 signals from the latch 74 via the parallel paths 87*b*, then the OR gate 76 sends the D0 through D127 signals to the analog switches 78 via parallel paths 87*c*. If the OR gate 76 receives a BLNK signal from the CPU 91*a* via a bus 85*e*, then the OR gate 76 outputs the D0 through D127 signals, which are High signals, to all the parallel paths 87*c* that are connected to all the analog switches 78.

The analog switches 78 selectively open and close the 128 current-carrying paths 87*d* which branch out from the current-carrying path 83 and send the Vsource voltage from the pulse amplifier 52 to each of the piezoelectric elements 42*a*. Based on the D0 through D127 signals that the OR gate 76 send via the parallel paths 87*c*, for example, if the D0 signal is at a High level, the corresponding analog switch 78 closes the current-carrying path 87*d* that corresponds to the D0 signal. If the next D1 signal is at a Low level, the corresponding analog switch 78 opens the current-carrying path 87*d* that corresponds to the D1 signal. In this way, the respective analog switch 78 selectively opens and closes the current-carrying path 87*d* that corresponds to each of the D0 through D127 signals.

Figure 6:
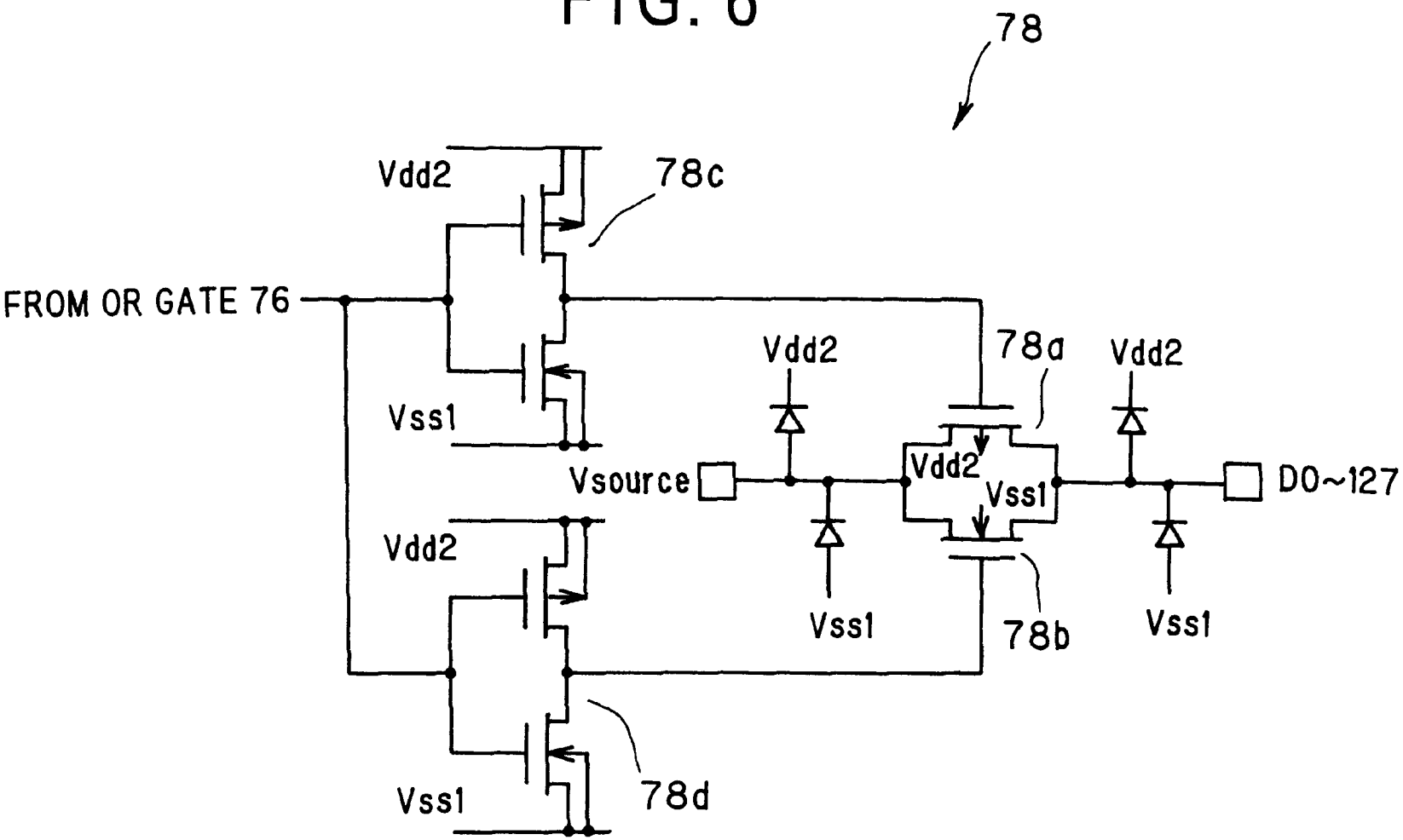
FIG. 6 is a circuit diagram showing an equivalent circuit of an analog switching device of the printer 1 according to the embodiment of the present invention.

FIG. 6 shows an equivalent circuit of one of the analog switches 78.

In FIG. 6, the analog switch 78 is provided with a plurality of FET (Field Effect Transistor) type transistors. The analog switch 78 is a so-called C-MOS transmission gate in which a P-MOS FET 78*a* and an N-MOS FET 78*b* are combined.

In this analog switch 78, the P-MOS FET 78*a* and the N-MOS FET 78*b* are connected in parallel. An output signal of the OR gate 76 is supplied to the gate input terminals of the P-MOSFET 78*a* and the N-MOSFET 78*b* via a C-MOSFET 78*c* and a C-MOSFET 78*d*, respectively. When the output of the OR gate 76 is at a High level, the inter source-drain region of the P-MOSFET 78*a* and that of the N-MOSFET 78*b* become non-conductive, so as to close the corresponding current-carrying path 87*d*. On the other hand, when the output of the OR gate 76 is at a Low level, the inter source-drain region of the P-MOSFET 78*a* and that of the N-MOSFET 78*b* become conductive, so as to open the corresponding current-carrying path 87*d*.

Next, an ink discharge control process of the CPU 91*a* for controlling the actuator 40 of the printer 1 to discharge the ink will be explained with reference to the flow chart shown in FIG. 7 and the timing chart shown in FIG. 8.

As the initial setting, it is assumed that the CPU 91*a* applies the Vsource voltage of the predetermined voltage of +Vs[V] to all the piezoelectric elements 42*a* by setting the BLNK signal and the Fire0C signal to the High levels so as to expand the piezoelectric elements 42*a*. In addition, it is also assumed that the ink flow paths 44*a* of the cavity plate 44 are filled with the ink.

Figure 7:
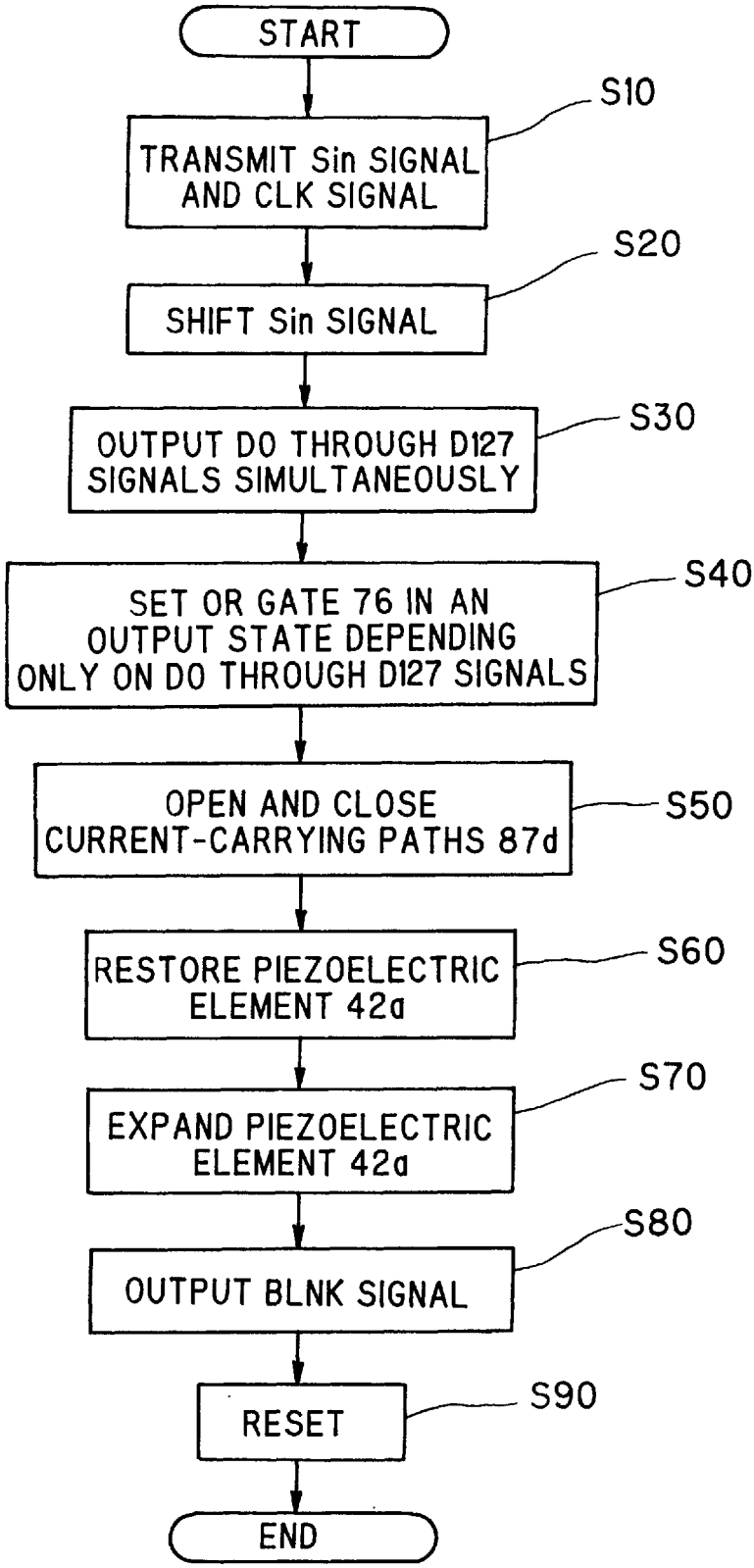
FIG. 7 is a flow chart of an ink discharge control process of the printer 1 according to the embodiment of the present invention.

In FIG. 7, at first, the Sin signal and the CLK signal are sent to the shift register 72 (step S10). For example, in the case where bit map data is to be formed by using the head according to the present embodiment, a cell matrix is set that is constituted of rectangular cells which match the resolution (dpi) in the RAM of the printer. Desired image data is developed on the cell matrix. Color information (yellow, magenta, cyan, black, or blank) is then assigned to each of the cells. Then, the CPU 91*a* sends data for the cells which can be discharged from the cell matrix at a time, e.g. 128 cells in the present embodiment, as the Sin signal to the bus 85*a* (at a timing J1 shown in FIG. 8).

Moreover, the CPU 91*a* transmits the CLK signal that is in synchronization with the Sin signal, e.g. 128 pulse-like CLK signals in the present embodiment. In FIG. 8, the Sin signal indicates only the last portion of the 128 printing data, and the CLK signal indicates only the last portion of the 128 pulses.

Next, the shift register 72 shifts the Sin signal (step S20). More concretely, the CPU 91*a* shifts the Sin signal, which is serial data, by inputting the CLK signal into the shift register 72. At the same time, the CPU 91*a* transmits the D0 signal through D127 signal from the parallel output sequentially to the latch 74 via the parallel bus 87*a*.

Next, the latch 74 simultaneously outputs the D0 signal through D127 signal (step S30). Specifically, the CPU 91*a* outputs the STRB (strobe) signal to the latch 74 via the bus 85f after a prescribed time interval T1 has passed since the last pulse of the CLK signal has risen up (at a timing J2 shown in FIG. 8). Then, the CPU 91*a* controls the latch 74 to simultaneously output the D0 signal through D127 signal that the latch 74 holds to the parallel bus 87*b*.

Next, the OR gate 76 is set in an output state which depends on only the D0 signal through D127 signal (step S40). Specifically, the CPU 91*a* outputs a BLNK signal at a Low level to the bus 85*e* in synchronization with the rising up of the STRB signal (at a timing J3 shown in FIG. 8). The CPU 91*a* then sets the parallel bus 87*c*, which is the output of the OR gate 76, in an output state that depends on only the D0 signal through D127 signal.

Next, the CPU 91*a* controls the analog switches 78 to open or close the current-carrying paths 87*d* (step S50). Specifically, when the CPU 91*a* inputs the D0 signal through D127 signal to the analog switches 78 via the parallel bus 87*c*, if respective one of the D0 signal through D127 signal is at a High level, the CPU 91*a* closes the corresponding current-carrying path 87*d*, and, if respective one of them is at a LOW level, the CPU 91*a* opens the corresponding current-carrying path 87*d*.

Next, the piezoelectric elements 42 are restored (step S60). More concretely, after a predetermined time interval T2 has passed since the CPU 91*a* has outputted the BLNK signal at a Low level, the CPU 91*a* outputs a Fire0C signal, which is at a Low level, to the bus 81*a*. Moreover, after a predetermined time interval T3 has passed since the CPU 91*a* has outputted the Fire0C signal at the Low level to the bus 81*a*, the CPU 91*a* outputs the Fire0C signal at a High level to the bus 81*b* (at a timing J4 shown in FIG. 8). As the Fire0C signal rises up, the Vsource voltage decreases from +Vs[V] to 0[V]. At this time, the driving voltages of those piezoelectric elements 42*a* that correspond to the closed current-carrying paths 87*d* among the current-carrying paths 87*d* connected to the analog switches 78 become 0[V]. On the other hand, the driving voltages of those piezoelectric elements 42*a* that correspond to the open current-carrying paths 87*d* are kept to be +Vs[V].

Then, those piezoelectric elements 42*a* whose driving voltages have become 0[V] are restored. As a result, the capacity of the respective ink storing chamber 44*b* of the cavity plate 44 is expanded correspondingly, and the ink flows from the ink flow path 44*a* to the respective ink storing chamber 44*b*.

Next, the piezoelectric elements 42*a* are expanded (step S70).

Figure 8:
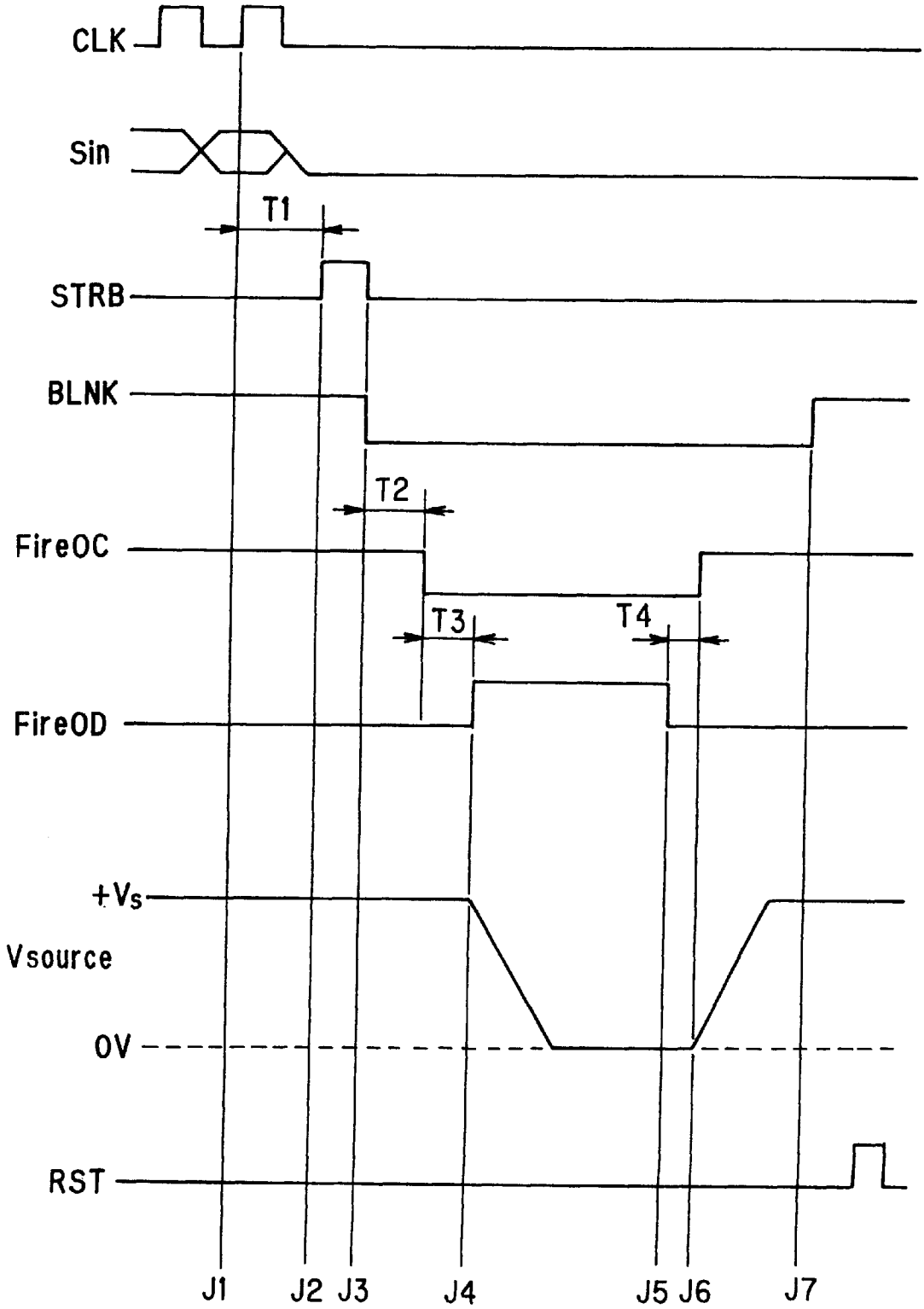
FIG. 8 is a timing chart of the ink discharge control process of the printer 1 according to the embodiment of the present invention.

More concretely, as shown in FIG. 8, the CPU 91*a* outputs the Fire0D signal, which is at the Low level, to the bus 81*b* at a timing J5. The CPU 91*a* then outputs the Fire0C signal, which is at the High level, to the bus 81*a*, at a timing J6 after a predetermined time interval T4 has passed.

Then, as the Fire0C signal rises up, the Vsource voltage starts to increase at the timing J6 from 0[V] to +Vs[V].

In the above mentioned manner, when the piezoelectric elements 42*a* are restored at the timing J4 on the basis of the Fire0D signal at the High level, the internal pressure of the ink storing chambers 44*b* decrease to a great extent. Hence, the ink flows into the internal of the ink storing chambers 44*b*. This causes the pressure of the ink inside the ink storing chambers 44*b* to grow too high. Due to the property of the liquid ink which tends to bring the pressure to an equilibrium, the ink flows back from the ink storing chambers 44*b* to the ink flow paths 44*a*. In this way, the ink flows back and forth between the ink storing chambers 44*b* and the ink flow paths 44*a*, so as to generate pressure waves (compression waves) in the ink.

Therefore, if the piezoelectric elements 42*a* are expanded at the timing when the pressure generated by the pressure waves that act in the direction to increase the internal pressure in the respective ink storing chamber 44*b* becomes the maximum (hereinbelow, it is referred to as a "positive direction") so as to apply the pressure to the ink, the discharge velocity of the ink becomes the maximum.

Hence, in the present embodiment, the Fire0C signal at the High level is inputted to the pulse amplifier 52 at the timing J6 when the pressure waves (compression waves) of the ink inside the cavity are the most densely compressed so that the ink discharge velocity will become the maximum. By this, the pulse amplifier 52 supplies the driving voltage of +Vs [V] to the piezoelectric elements 42*a*. The piezoelectric elements 42*a* then reduce the capacity of the respective ink storing chambers 44*b* at the timing J6, and apply the pressure to the ink. Thus, the maximum ink discharge velocity is obtained. As a result, even if the gap between the head 20 and the recording paper R varies to some extent, the discharged ink can hit a prescribed spot on the recording paper R with an improved degree of accuracy.

Next, the BLNK signal is outputted (step S80). More concretely, after the piezoelectric elements 42*a* have been charged with the electric power of the voltage +Vs [V] as shown in FIG. 6, at the timing when the Fire0C signal at the High level is inputted, the CPU 91*a* outputs the BLNK signal at the High level via the bus 85e (at a timing J7 shown in FIG. 8).

By closing all the current-carrying paths 87*d*, the Vsource voltage of +Vs[V] is applied to all the piezoelectric elements 42*a*.

Next, the CPU 91*a* resets the shift register 72 and the latch 74 by outputting the RST signal via the bus 85*d* (step S90). This completes the ink discharge control process.

By the above-described control operation, the discharged ink can hit a prescribed spot on the recording paper R with an improved degree of accuracy. As a result, a uniform sharp image can be recorded on the recording paper R. In addition, by discharging a suitable amount of ink, an excellent image can be recorded.

However, as aforementioned, the ink discharge velocity of the ink jet head varies depending on the variations of constituent parts such as the nozzle plate 45, the cavity plate 44, the piezoelectric element member 42 and so on.

In order to correct this variation in the ink discharge velocity, it suffices to adjust the driving voltage and the driving voltage waveform for the piezoelectric elements 42*a*. However, it is a cumbersome operation to adjust both of the driving voltage and the driving voltage waveform since they interact with each other.

Figure 9:
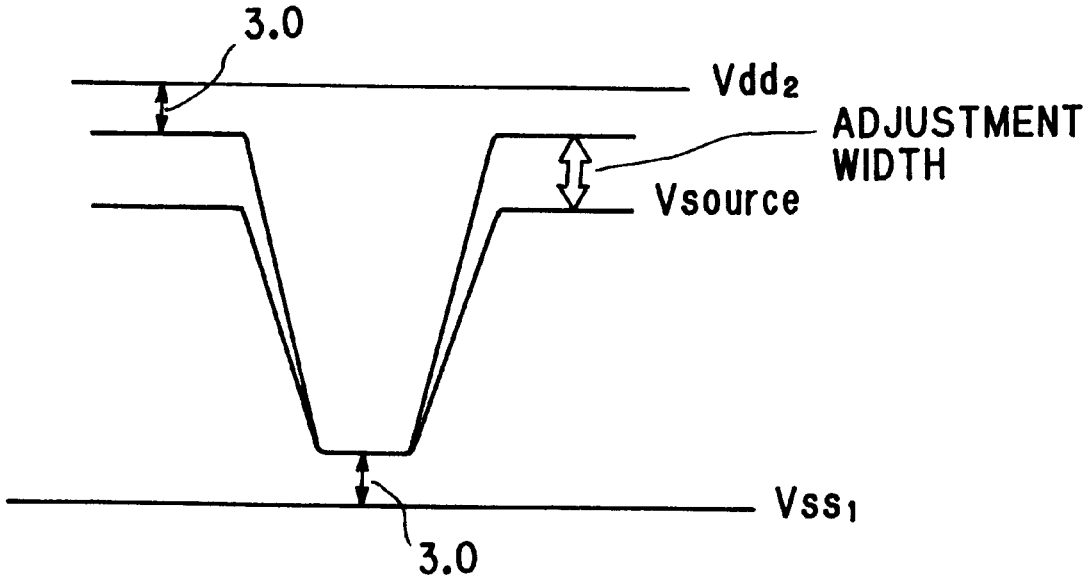
FIG. 9 is a waveform diagram showing a principle of an ink discharge velocity adjusting method in a comparison example.

Here, FIG. 9 shows a principle of a method of correcting this variation in the ink discharge velocity, in which the voltage value of the voltage Vsource is adjusted by adjusting bias circuits and the like inside the switching circuits 54 and 56, as a comparison example in line with the conventional technology.

However, in this comparison example, since the above described correction operation is performed by adjusting only the voltage Vsource, the voltage must be adjusted over a wide range as shown in FIG. 9. Corresponding to this voltage adjustment, the voltage Vdd2, which is the power source voltage for the analog switches 78, needs to be as high as voltage Vsource +α.

In other words, since the voltage Vsource needs to be adjusted within the range between the voltage Vdd2 voltage and the voltage Vss1 as understood from FIG. 6, the voltage Vdd2 needs to be set high corresponding to the variation width of the voltage Vsource.

Therefore, this comparison example has not only a problem in the increase of the cost for the power source, but also a problem in the safety hazard since the very high voltage needs to be outputted.

In contrast to this, in the present embodiment, the above-described problems in the comparison example are solved by adjusting the value of the power source voltage supplied to the analog switches 78.

Figure 10:
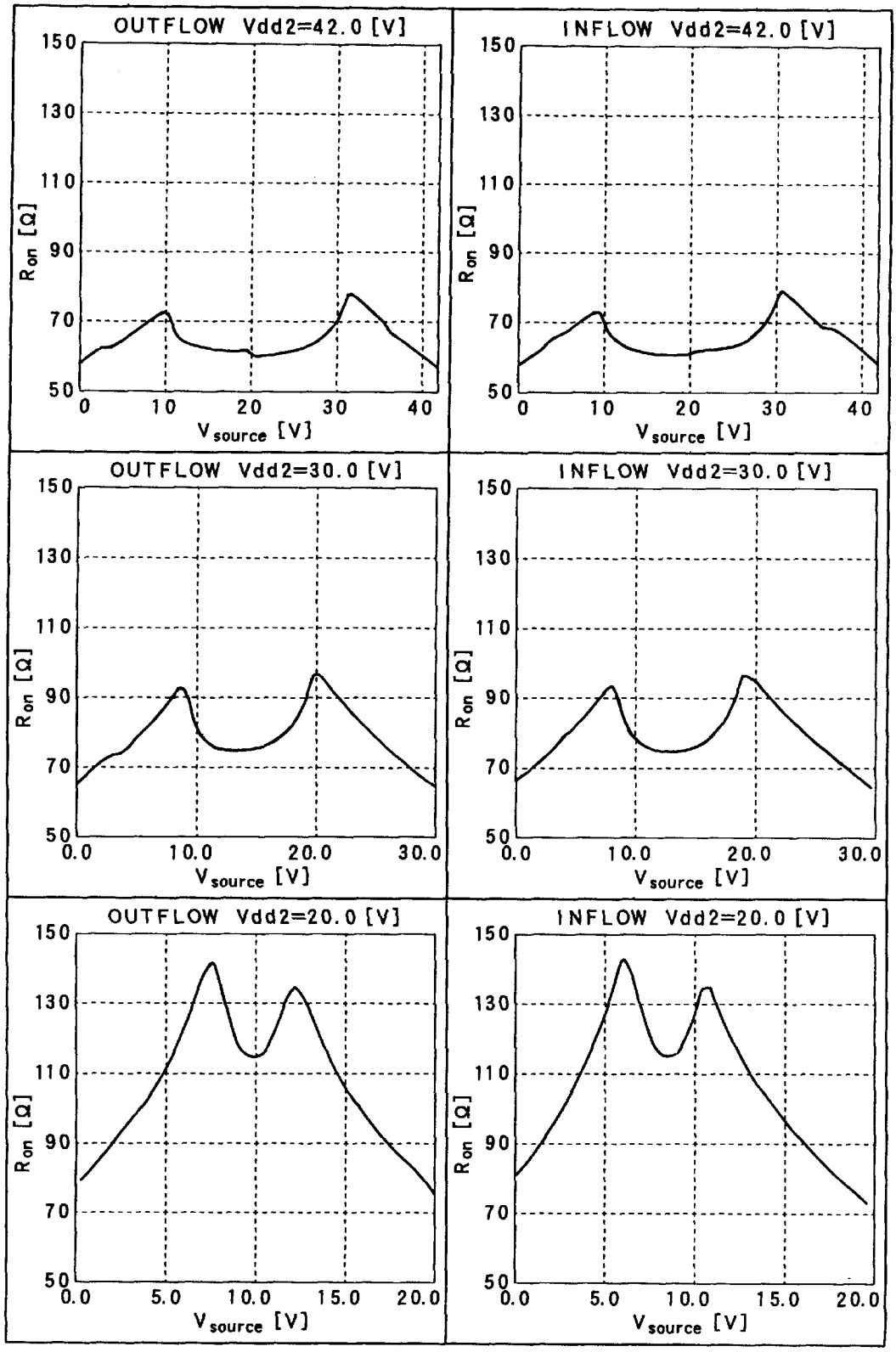
FIG. 10 is a set of graphs showing the relation between an ON resistance and an electric power source voltage of the analog switching device of the printer 1 according to the embodiment of the present invention.

Namely, the present embodiment utilizes such characteristics of the FETs which constitute the analog switches 78 that the ON resistance of the FET increases as the power source voltage decreases, as shown in FIG. 10. In other words, as the ON resistance increases, the rate of the change of the afore-described driving voltage waveform decreases. As a result, the driving voltage waveform exhibits a curve-like change. Corresponding to this curve-like change, the afore-described ink discharge velocity decreases. Conversely, as the ON resistance decreases, the rate of the change of the above-described waveform of the driving wave increases. As a result, the driving voltage waveform exhibits a linear-like change. Corresponding to this linear-like change, the above-described ink discharge velocity increases. In this manner, since the ink discharge velocity can be corrected by adjusting the value of the power source voltage, the adjustment width or range of the Vsource voltage value itself can be reduced by this correction amount.

Figure 11:
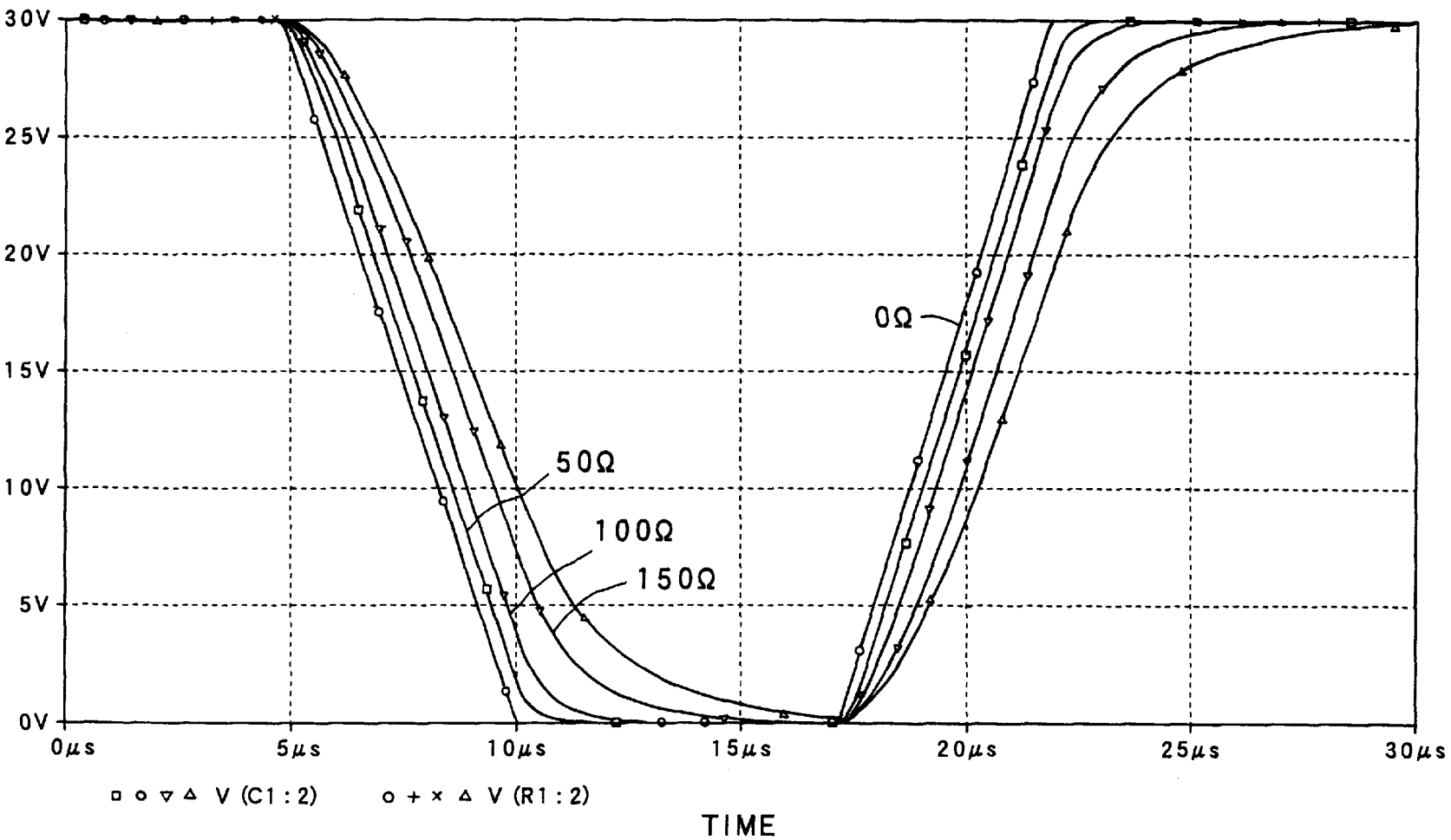
FIG. 11 is a graph showing changes in the driving voltage waveform as the electric power source voltage of the analog switching device of the printer 1 according to the embodiment of the present invention is changed.

FIG. 11 shows the change in the driving voltage waveform when the power source voltage value is changed. In this example, the voltage Vdd2 is changed from 42[V] to 20[V]. The ON resistance is changed to 0, 50, 100 and 150[Ω]. The rate of change of the driving voltage waveform is decreased as shown in FIG. 11 as the ON resistance is increased.

Figure 12A:
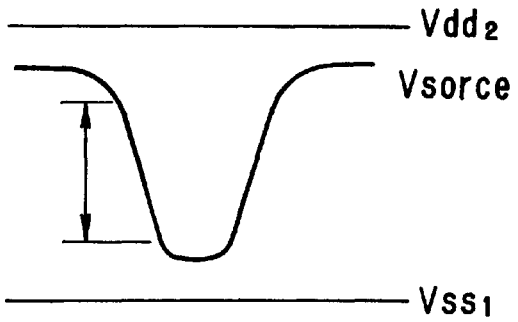
FIG. 12A is a waveform diagram of the ink discharge velocity adjustment in the printer 1 according to the embodiment of the present invention, in which the change of the driving voltage waveform as the electric power source voltage of the analog switching device is changed is indicated.

Therefore, according to the present embodiment, as shown in FIG. 12A, when the ink discharge velocity is to be decreased, not only the rate of change in the driving voltage waveform is decreased by lowering the value of the voltage Vdd2, but also the value of the voltage Vsource is adjusted.

Figure 12B:
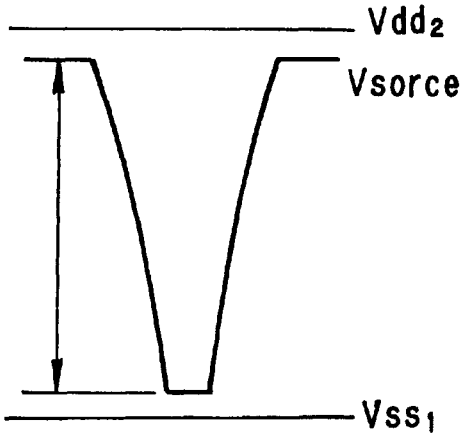
FIG. 12B is a waveform diagram of the ink discharge velocity adjustment in the comparison example.

In order to increase the ink discharge velocity, the reverse of this process is performed, and the voltage Ydd2 is increased as shown in FIG. 12B.

More concretely, the variable resistor 95 as one example of a power source voltage adjusting device is connected to the reference terminal (REF) of the power source circuit 94 as one example of a power source voltage supply device, and the value of the power source circuit 94 is adjusted with this variable resistor 95. It should be noted that, according to the present embodiment, a Zener circuit 93 maintains a prescribed constant voltage difference between the maximum value Vs of the voltage Vsource and the value of the power source voltage.

Therefore, by adjusting the value of the power source voltage, the value of the driving voltage also changes. However, the width of this change of the driving voltage can be made much smaller than that in the comparison example (as shown in FIG. 9), due to the influence of the change in the driving voltage waveform.

The value of the driving voltage is adjusted by the value of the power source voltage and the Zener circuit 93 while the slope of the waveform is adjusted by adjusting the value of the current of a constant current circuit, which serves as one example of an adjusting device for adjusting the slope of the waveform installed in the switching circuits 54 and 56 respectively for the above-mentioned pulse amplifier 52. More concretely, the constant current circuit for the charging side is installed in the switching circuit 54, while the constant current circuit for the discharging side is installed in the switching circuit 56. By adjusting a trimmer (e.g., a variable resistor) in each of the switching circuits 54 and 56, the values of these constant currents can be set to desired values respectively, such that each constant current value is set smaller in order to decrease the slope of the waveform and is set larger in order to increase the slope of the waveform.

As describe above, according to the present embodiment, upon adjusting the ink discharge velocity, the adjustment width or range of the driving voltage for the analog switch can be made much smaller than that of the comparison example in line with the aforementioned related art by adjusting the power source voltage of the analog switch, resulting in that it is unnecessary to vary the power source voltage over a wide range. Consequently, the cost of the power source can be reduced, and the safety can be improved.

Incidentally, in the above-described embodiment, the case in which the value of the power source voltage is adjusted by use of the variable resistor is explained. However, the range of application of the present invention is not restricted to this case. For example, by connecting the CPU 91*a* with the reference terminal of the power source circuit 94, the value of the power source voltage may be adjusted by use of a control signal supplied from the CPU 91*a*.

As has been explained so far, according to the present embodiment, at least one of the slope and the amplitude of the waveform of the driving voltage Vsource applied to the piezoelectric elements 42 is or are changed. In addition, the value of the power source voltage Vdd2 for the analog switches 78 is changed. Therefore, by changing the ON resistance of the analog switches 78, the waveform of the driving voltage Vsource can be changed, and the ink discharge velocity can be adjusted. As a result, the amount required to adjust the driving voltage Vsource can be reduced. Consequently, the cost of the power source circuit can be reduced and the safety can be improved.

Further, since the ink jet printer changes one or both of the slope and the amplitude of the waveform in accordance with the change in the power source voltage value Vdd2, the driving voltage Vsource having a pulse-like shape can be always confined within a prescribed power source voltage range. As a result, the analog switches 78 can be properly driven.

Furthermore, the ink jet printer has the first switching circuit 54 for decreasing the driving voltage and the second switching circuit 56 for increasing the driving voltage, and the first switching circuit 54 and the second switching circuit 56 share the power source voltage with the analog switching devices 78. More concretely, the power source voltage at the voltage value Vdd2 for the analog switches 78 in FIG. 6 is the same as the power source voltage outputted by the power source circuit 94 in FIG. 5. Therefore, an appropriate shape can be created for the waveform of the driving voltage. In addition, the driving voltage can be confined within a prescribed power source voltage range. As a result, the analog switches 78 can be properly driven.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 09-172436 filed on Jun. 27, 1997 including the specification, claims, drawings and summary is incorporated herein by reference in its entirety.

What is claimed is:

1. An ink jet printer, comprising:

an ink discharge device for discharging ink, having (i) a body prescribing an ink flow path through which the ink is supplied, a plurality of ink storing chambers each connected to the ink flow path in which the supplied ink is temporarily stored and a plurality of ink discharge holes connected to respective one of the ink storing chambers though which the temporarily stored ink is discharged, and (ii) a plurality of actuators for selectively applying pressure fluctuation to the ink in the ink storing chambers;

a driving voltage generating device for generating a driving voltage having a pulse-like waveform, which causes the ink to be discharged from each of the ink discharge holes by inducing the pressure fluctuation with the respective one of the actuators;

a plurality of analog switching devices for selectively opening and closing each current-carrying path, through which the driving voltage is supplied to the respective one of the actuators;

a power source voltage supplying device for supplying a power source voltage to the analog switching devices;

a driving voltage adjusting device for changing at least one of a slope and an amplitude of the waveform of the driving voltage; and a power source voltage adjusting device for changing the power source voltage, wherein each of the analog switching devices includes a transistor having an input terminal as an input of the corresponding current-carrying path, an output terminal as an output of the corresponding current-carrying path and a switching state control terminal for controlling open or close of the corresponding current-carrying path, and an ON-resistance between the input terminal and the output terminal of the transistor in a state that the corresponding current-carrying path is closed is changed with a change in the power source voltage.

2. An ink jet printer according to claim 1, wherein the driving voltage adjusting device changes at least one of the slope and the amplitude of the waveform in accordance with the change in the power source voltage which is caused by the power source voltage adjusting device.

3. An ink jet printer according to claim 2, wherein the driving voltage generating device comprises a first switching device for decreasing the driving voltage from a predetermined maximum value to a predetermined minimum value and a second switching device for increasing the driving voltage from the predetermined minimum value to the predetermined maximum value, the first switching device and the second switching device sharing the power source voltage, which is changed by the power source voltage adjusting device, with the analog switching devices.

4. An ink jet printer according to claim 1, wherein said power source voltage adjusting device comprises a variable resistor and a Zener circuit for changing the power source voltage.

5. The ink jet printer according to claim 1, wherein the driving voltage adjusting device changes at least one of the slope and the amplitude of the waveform of the driving voltage by changing the ON-resistance in the transistor of each of the analog switching devices in accordance with the change in the power source voltage which is caused by the power source voltage adjusting device.

6. A method of adjusting an ink discharge velocity of an ink jet printer, said ink jet printer comprising:

an ink discharge device for discharging ink, having (i) a body prescribing an ink flow path through which the ink is supplied, a plurality of ink storing chambers each connected to the ink flow path in which the supplied ink is temporarily stored and a plurality of ink discharge holes connected to respective one of the ink storing chambers though which the temporarily stored ink is discharged, and (ii) a plurality of actuators for selectively applying pressure fluctuation to the ink in the ink storing chambers;

a driving voltage generating device for generating a driving voltage having a pulse-like waveform, which causes the ink to be discharged from each of the ink discharge holes by inducing the pressure fluctuation with the respective one of the actuators;

a plurality of analog switching devices for selectively opening and closing each current-carrying path, through which the driving voltage is supplied to the respective one of the actuators; and a power source voltage supplying device for supplying a power source voltage to the analog switching devices, said method comprising:

a driving voltage adjusting process of changing at least one of a slope and an amplitude of the waveform of the driving voltage, which is generated by said driving voltage generating device; and a power source voltage adjusting process of changing the power source voltage, which is supplied by said power source voltage supplying device, wherein each of the analog switching devices includes a transistor having an input terminal as an input of the corresponding current-carrying path, an output terminal as an output of the corresponding current-carrying path and a switching state control terminal for controlling open or close of the corresponding current-carrying path, and an ON-resistance between the input terminal and the output terminal of the transistor in a state that the corresponding current-carrying path is closed is changed with a change in the power source voltage.

7. A method according to claim 6, wherein the driving voltage adjusting process changes at least one of the slope and the amplitude of the waveform in accordance with the change in the power source voltage which is caused by the power source voltage adjusting process.

8. A method according to claim 7, wherein the driving voltage generating device shares the power source voltage, which is changed by the power source voltage adjusting process, with the analog switching devices.

9. The method according to claim 6, wherein the driving voltage adjusting process comprises a process of changing at least one of the slope and the amplitude of the waveform of the driving voltage by changing the ON-resistance in the transistor of each of the analog switching devices in accordance with the change in the power source voltage which is caused by the power source voltage adjusting process.

10. An apparatus for adjusting an ink discharge velocity of an ink jet printer, said ink jet printer comprising:

an ink discharge device for discharging ink, having (i) a body prescribing an ink flow path through which the ink is supplied, a plurality of ink storing chambers each connected to the ink flow path in which the supplied ink is temporarily stored and a plurality of ink discharge holes connected to respective one of the ink storing chambers though which the temporarily stored ink is discharged, and (ii) a plurality of actuators for selectively applying pressure fluctuation to the ink in the ink storing chambers;

a driving voltage generating device for generating a driving voltage having a pulse-like waveform, which causes the ink to be discharged from each of the ink discharge holes by inducing the pressure fluctuation with the respective one of the actuators;

a plurality of analog switching devices for selectively opening and closing each current-carrying path, through which the driving voltage is supplied to the respective one of the actuators; and a power source voltage supplying device for supplying a power source voltage to the analog switching devices, said apparatus comprising:

a driving voltage adjusting device for changing at least one of a slope and an amplitude of the waveform of the driving voltage; and a power source voltage adjusting device for changing the power source voltage, wherein each of the analog switching devices include a transistor having an input terminal as an input of the corresponding current-carrying path, an output terminal as an output of the corresponding current-carrying path and a switching state control terminal for controlling open or close of the corresponding current-carrying path, and an ON-resistance between the input terminal and the output terminal of the transistor in a state that the corresponding current-carrying path is closed is changed with a change in the power source voltage.

11. An apparatus according to claim 10, wherein the driving voltage adjusting device changes at least one of the slope and the amplitude of the waveform in accordance with the change in the power source voltage which is caused by the power source voltage adjusting device.

12. An apparatus according to claim 11, wherein the driving voltage generating device comprises a first switching device for decreasing the driving voltage from a predetermined maximum value to a predetermined minimum value and a second switching device for increasing the driving voltage from the predetermined minimum value to the predetermined maximum value, the first switching device and the second switching device sharing the power source voltage, which is changed by the power source voltage adjusting device, with the analog switching devices.

13. An apparatus according to claim 10, wherein said power source voltage adjusting device comprises a variable resistor and a Zener circuit for changing the power source voltage.

14. The apparatus according to claim 10, wherein the driving voltage adjusting device changes at least one of the slope and the amplitude of the waveform of the driving voltage by changing the ON-resistance in the transistor of each of the analog switching devices in accordance with the change in the power source voltage which is caused by the power source voltage adjusting device.

* * * * *